US007063074B2

(12) United States Patent
Horibe et al.

(10) Patent No.: US 7,063,074 B2
(45) Date of Patent: Jun. 20, 2006

(54) APPARATUS FOR PROTECTING A FUEL SYSTEM COMPONENT FOR AN ENGINE

(75) Inventors: Takehiro Horibe, Aichi (JP); Koji Asano, Nagoya (JP); Syoji Kobiyama, Nagoya (JP); Akio Iwamoto, Yokohama (JP); Takahiro Yata, Kanagawa (JP)

(73) Assignees: Nissan Motor Co., LTD, Yokohama (JP); Aichi Machine Industry Co., Ltd., Nagoya (JP); Renault s.a.s. societe par actions Simplifiee, Boulogne-Billancourt (FR)

( * ) Notice: Subject to any disclaimer, the term of this patent is extended or adjusted under 35 U.S.C. 154(b) by 0 days.

(21) Appl. No.: 10/775,133

(22) Filed: Feb. 11, 2004

(65) Prior Publication Data

US 2004/0159302 A1 Aug. 19, 2004

(30) Foreign Application Priority Data

Feb. 14, 2003 (JP) ..... 2003-036858

(51) Int. Cl.
*F02M 63/00* (2006.01)

(52) U.S. Cl. ..... 123/469; 123/468

(58) Field of Classification Search ..... 123/469, 123/468, 456

See application file for complete search history.

(56) References Cited

U.S. PATENT DOCUMENTS

| | | | | |
|---|---|---|---|---|
| 5,092,300 | A * | 3/1992 | Imoehl et al. | 123/469 |
| 6,340,019 | B1 * | 1/2002 | Eshleman et al. | 123/469 |
| 6,341,595 | B1 * | 1/2002 | Scollard et al. | 123/456 |
| 6,622,700 | B1 * | 9/2003 | Lee et al. | 123/456 |
| 6,691,381 | B1 * | 2/2004 | Scollard et al. | 24/459 |
| 6,817,337 | B1 * | 11/2004 | Siring et al. | 123/198 E |
| 6,840,225 | B1 * | 1/2005 | Sandoval | 123/469 |

FOREIGN PATENT DOCUMENTS

JP 2001-317436 A 11/2001

* cited by examiner

*Primary Examiner*—Henry C. Yuen
*Assistant Examiner*—Jason Benton
(74) *Attorney, Agent, or Firm*—Foley & Lardner LLP

(57) ABSTRACT

An apparatus for protecting a fuel system component disposed on an engine body in a vehicle, the apparatus including a protector including a first wall and a second wall connected with the first wall. The first and second walls extend toward the engine body and cooperate with each other to surround the fuel system component. The second wall has one end opposed to the engine body with a clearance. A first fastening member fixes the first wall to the engine body.

11 Claims, 7 Drawing Sheets

APPARATUS FOR PROTECTING A FUEL SYSTEM COMPONENT FOR AN ENGINE

BACKGROUND OF THE INVENTION

The present invention relates to an improved apparatus for protecting a fuel system component mounted to an engine body of a vehicle.

In a vehicle equipped with an engine, it is required to prevent fuel leakage from a fuel system component mounted to the engine body on the occurrence of vehicle collision from a viewpoint of safety. Japanese Patent Application First Publication No. 2001-317436 discloses an apparatus for protecting a fuel system component mounted to an engine body. The apparatus of this related art includes a protector that has a generally rectangular box shape so as to surround a fuel system component, for instance, a fuel pipe and a fuel injector. The protector has two fixed portions on an upper wall thereof which is secured to an intake manifold by means of bolts, and two fixed portions on a side wall thereof which is secured to a cylinder head by means of bolts.

SUMMARY OF THE INVENTION

A protector for a fuel system component mounted to an engine and fixed portions of the protector which are fixed to the engine body must be enhanced in strength and rigidity in order to protect the fuel system component without being substantially adversely deformed in a case where an extremely large load is applied to a vehicle on the occurrence of a front collision of the vehicle. For this reason, the thickness and size of the protector will be increased as well as the number of the fixed portions to the engine body and the dimensions of fastening bolts and boss portions for receiving the fastening bolts.

It is an object of the present invention to provide an improved apparatus for protecting a fuel system component disposed on an engine body, including a protector and fixed portions thereof to the engine body which are reduced in weight and simplified in structure without deteriorating the protection function.

In one aspect of the present invention, there is provided an apparatus for protecting a fuel system component disposed on an engine body in a vehicle, the apparatus comprising:

a protector including a first wall and a second wall connected with the first wall, the first and second walls extending toward the engine body and cooperating with each other to surround the fuel system component, the second wall having one end opposed to the engine body with a clearance; and a first fastening member fixing the first wall to the engine body.

DETAILED DESCRIPTION OF THE INVENTION

Figure 2:
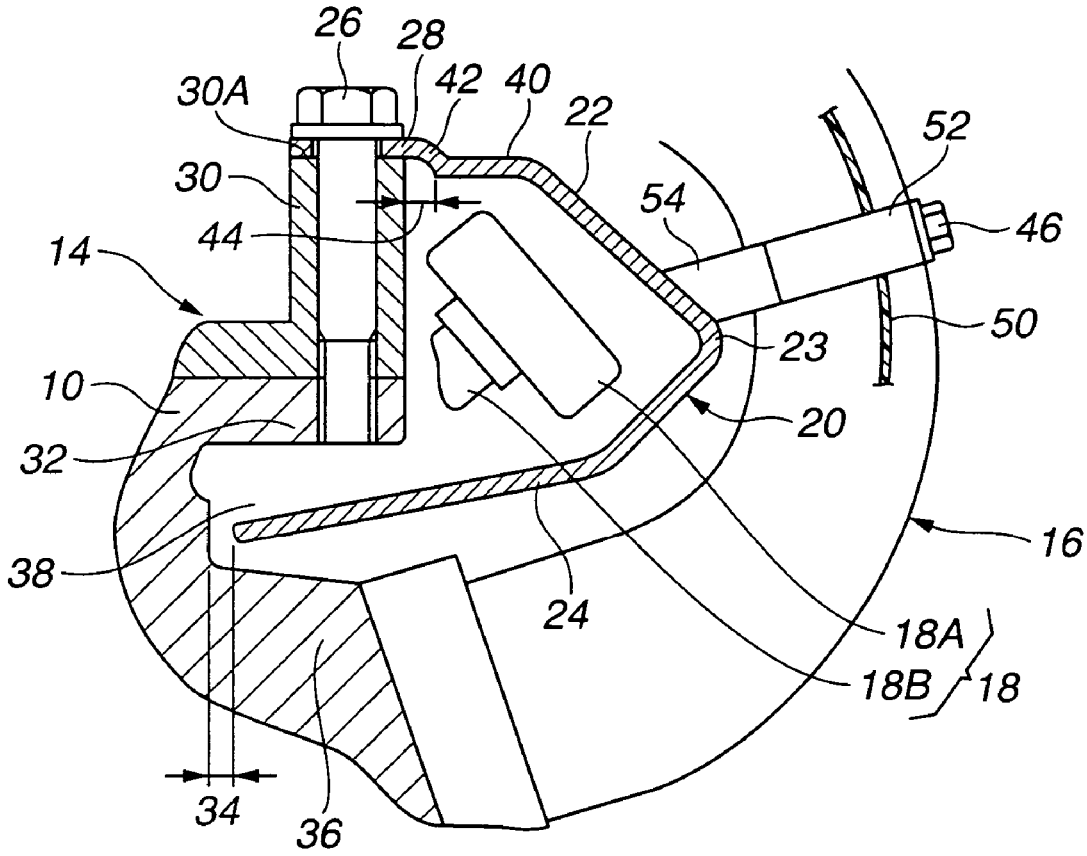
FIG. 2 is a sectional view taken along line 2—2 of FIG. 1.
Figure 3:
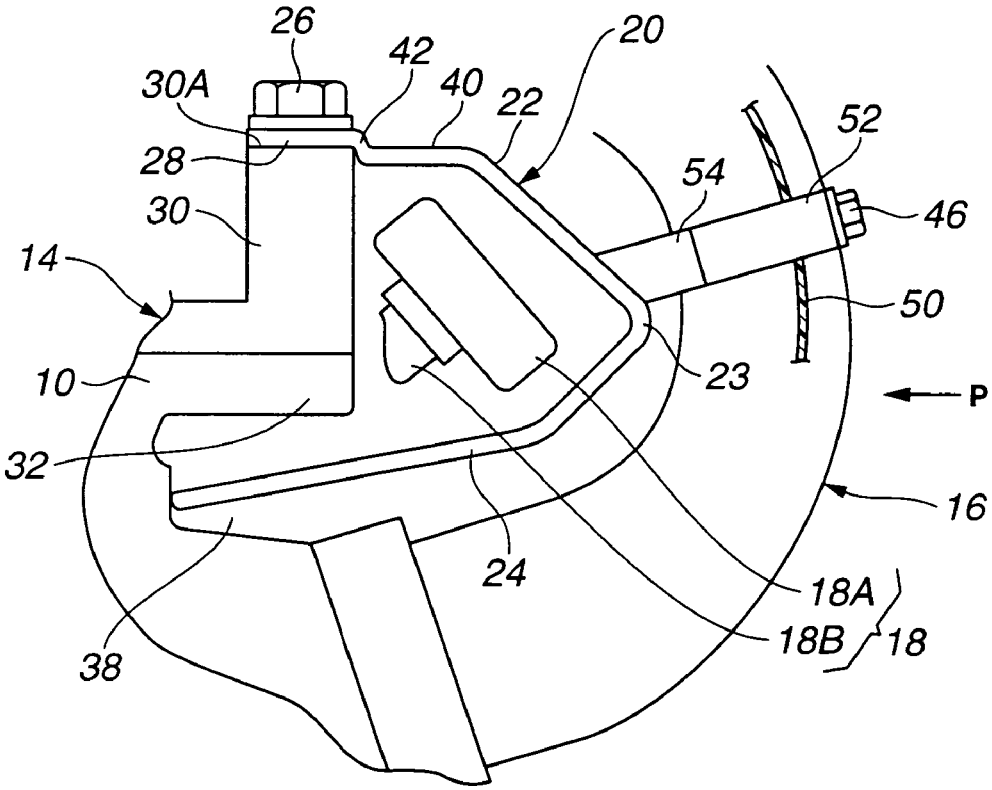
FIG. 3 is a sectional view of the apparatus of the first embodiment, showing a state when a load is applied to the apparatus.
Figure 4:
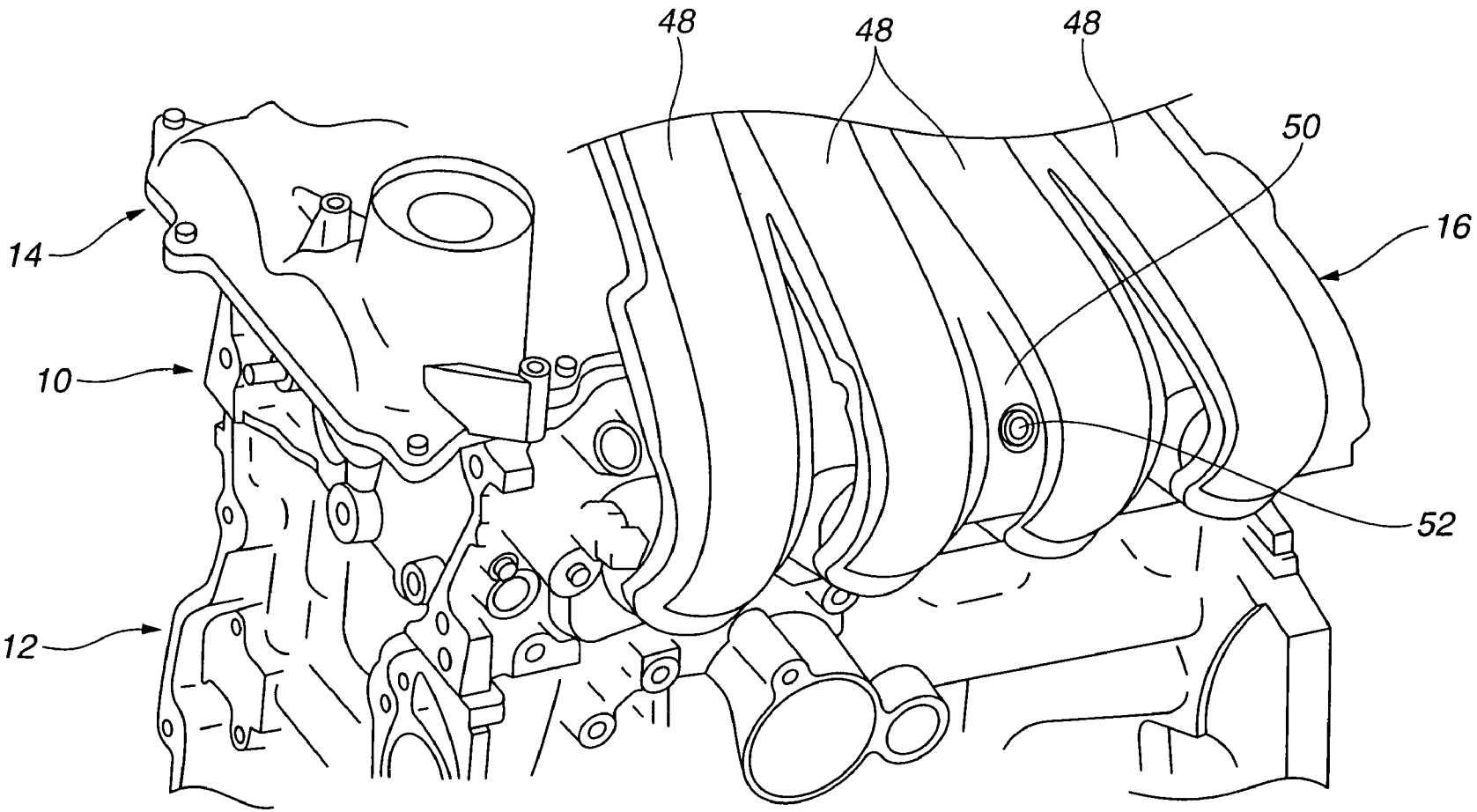
FIG. 4 is a perspective view of the engine to which the apparatus of the present invention is applicable, as viewed from an intake side thereof, namely, a front side of a vehicle.

Referring to FIGS. 1 to 4, an apparatus for protecting a fuel system component for an engine, according to a first embodiment of the present invention is explained. In this embodiment, the apparatus is applied to an engine that is installed in a so-called FF vehicle, i.e., a front-engine front-drive vehicle, in a lateral position where an intake side of the engine is located on the front side of the vehicle and an exhaust side is located on the rear side of the vehicle. As illustrated in FIG. 4, the engine has a body including cylinder head 10, cylinder block 12 and rocker cover 14. Cylinder head 10 and cylinder block 12 are made of suitable metal, for instance, cast iron, aluminum alloy or the like, which has a relatively large strength and rigidity. Cylinder head 10 and cylinder block 12 are secured to each other through a head gasket, not shown. Rocker cover 14 is secured to an upper end of cylinder head 10 so as to cover an upper surface of cylinder head 10. Intake manifold 16 is mounted to a side wall of cylinder head 10 which is located on the intake side, namely, the front side of the vehicle. Intake manifold 16 is made of a resin material having relatively light weight and low cost. Intake manifold 16 has a curved configuration so as to extend over rocker cover 14 and connect to an air cleaner case accommodating a throttle valve, not shown.

As illustrated in FIG. 2, fuel system component 18 is disposed on the intake side wall of the engine body. Fuel system component 18 includes fuel tube 18A and fuel injection valve 18B. Specifically, fuel system component 18 is arranged in a space defined by the intake side wall of the engine body and intake manifold 16. Fuel tube 18A is adapted to supply fuel to fuel injection valve 18B. Fuel injection valve 18B has an end portion disposed near an intake port formed in cylinder head 10. Fuel injection valve 18B is operative to inject the fuel supplied via fuel tube 18A toward the intake port.

Figure 1:
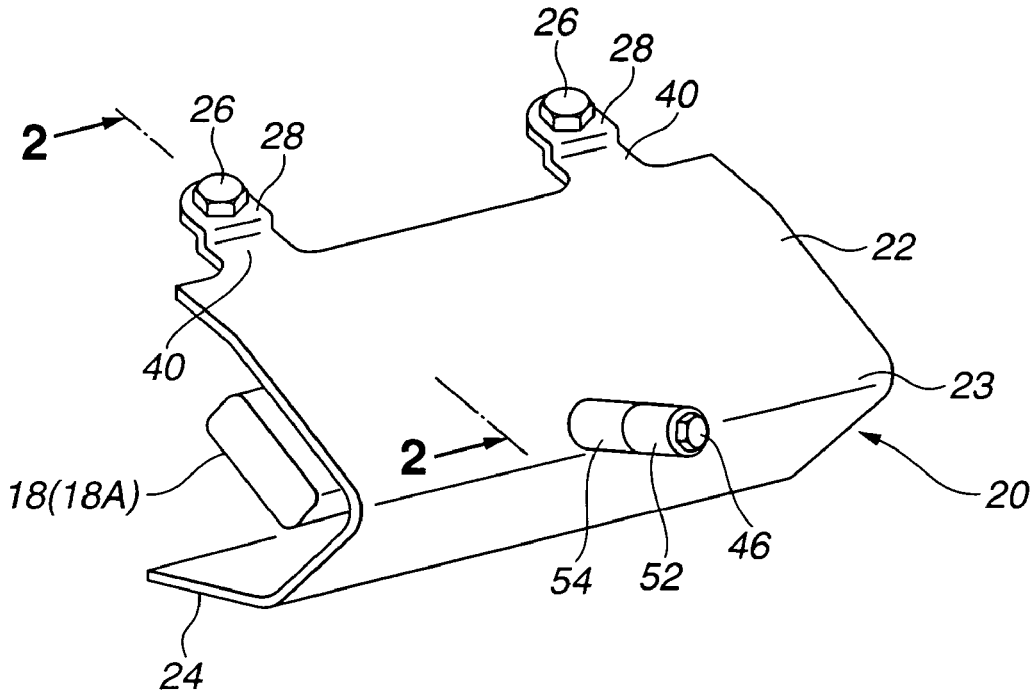
FIG. 1 is a perspective view of an apparatus for protecting a fuel system component for an engine, according to a first embodiment of the present invention.

Protector 20 is arranged so as to cover fuel system component 18. Protector 20 has a generally C-shape in section so as to surround fuel system component 18 as shown in FIG. 2. Protector 20 is formed by subjecting a relatively thin metal plate to presswork. As illustrated in FIGS. 1 and 2, protector 20 includes first wall 22, second wall 24 and bend 23 disposed between first and second walls 22 and 24. First and second walls 22 and 24 are connected with each other via bend 23. First and second walls 22 and 24 extend from bend 23 toward the intake side wall of the engine body and cooperate with bend 23 to surround fuel system component 18. Specifically, first wall 22 extends over an upper side of fuel system component 18 toward an intake side wall of rocker cover 14. Second wall 24 extends over a lower side of fuel system component 18 toward an intake side wall of cylinder head 10. First and second walls 22 and 24 and bend 23 thus cooperate with one another to cover an outside of fuel system component 18 as a whole.

First wall 22 disposed above fuel system component 18 is secured to rocker cover 14 and cylinder head 10 by means of main fastening member 26. Two main bolts serve as main fastening members 26 in this embodiment. Specifically, first wall 22 includes a pair of fixed portions 28 fixed to the engine body, one of which is shown in FIG. 2. As illustrated in FIG. 1, fixed portions 28 are spaced apart from each other in a longitudinal direction of first wall 22. As illustrated in FIG. 2, each of fixed portions 28 extends toward the intake side wall of rocker cover 14. Fixed portion 28 is placed on seat 30A of first main boss 30 formed integrally with the intake side wall of rocker cover 14. Fixed portion 28 thus overlapping on first main boss 30 is fixed by each of main fastening members 26 to first main boss 30 and second main boss 32 that is formed integrally with the intake side wall of cylinder head 10. Main fastening member 26 is inserted into a mount hole of fixed portion 28 and screwed into first and second main bosses 30 and 32. By tightening main fastening members 26, protector 20 is secured to the engine body, and at the same time, rocker cover 14 is secured to cylinder head 10. Thus, main fastening member 26 can act for fixing protector 20 to the engine body and fixing rocker cover 14 to cylinder head 10. This can reduce the number of fastening members to thereby contribute to a simple structure of the fuel system component protecting apparatus.

As illustrated in FIG. 2, first wall 22 further includes abutting portion 40 that is offset therefrom in a downward direction of the engine body, namely, in an axial direction of main fastening member 26. Abutting portion 40 is designed so as to be displaced to an abutment position where a distal end thereof abuts on first main boss 30 when an impact load is applied to protector 20 toward the engine body, namely, toward the rear side of the vehicle, upon the occurrence of vehicle front collision as explained later. Abutting portion 40 is connected with fixed portion 28 via step 42 and formed integrally therewith by bending. The distal end of abutting portion 40 is opposed to a circumferential side surface of first main boss 30 with clearance 44. Clearance 44 may be set to 3 to 5 mm.

Second wall 24 disposed below fuel system component 18 has a distal end opposed to the intake side wall of cylinder head 10 with clearance 34 therebetween. Specifically, second wall 24 has a free end portion that is located on the side of the engine body and free from being fixed to the engine body. Cylinder head 10 has second main boss 32, intake manifold mounting portion 36 which outwardly expand from the intake side wall of cylinder head 10, and receptacle portion 38 disposed between intake manifold mounting portion 36 and second main boss 32. Second main boss 32 is disposed on the underside of first main boss 10 in an overlapping state. Intake manifold mounting portion 36 supports intake manifold 16. Receptacle portion 38 receives the free end portion of second wall 24. Receptacle portion 38 is provided in the form of a recess that is formed in the intake side wall of cylinder head 10 so as to surround the free end portion of second wall 24 with a clearance. The free end portion of second wall 24 is opposed to a bottom of receptacle portion 38 with clearance 34 between the distal end and the bottom. Clearance 34 may be set to 3 to 5 mm.

Protector 20 is also secured to intake manifold 16 by means of subsidiary fastening member 46, namely, one subsidiary bolt in this embodiment. Specifically, intake manifold 16 includes thin-film rib 50 that is disposed between two adjacent intake branches 48 so as to connect with intake branches 48. First subsidiary boss 52 having a generally cylindrical shape is provided on one of ribs 50. Second subsidiary boss 54 having a generally cylindrical shape is provided on first wall 22 of protector 20. As shown in FIG. 1, second subsidiary boss 54 is located near bend 23, namely, on the side distant from the engine body, at a position corresponding to substantially an intermediate position between the two fixed portions 28. Subsidiary fastening member 46 is inserted into first and second subsidiary bosses 52 and 54 and tightened to couple first and second subsidiary bosses 52.

Figure 9:
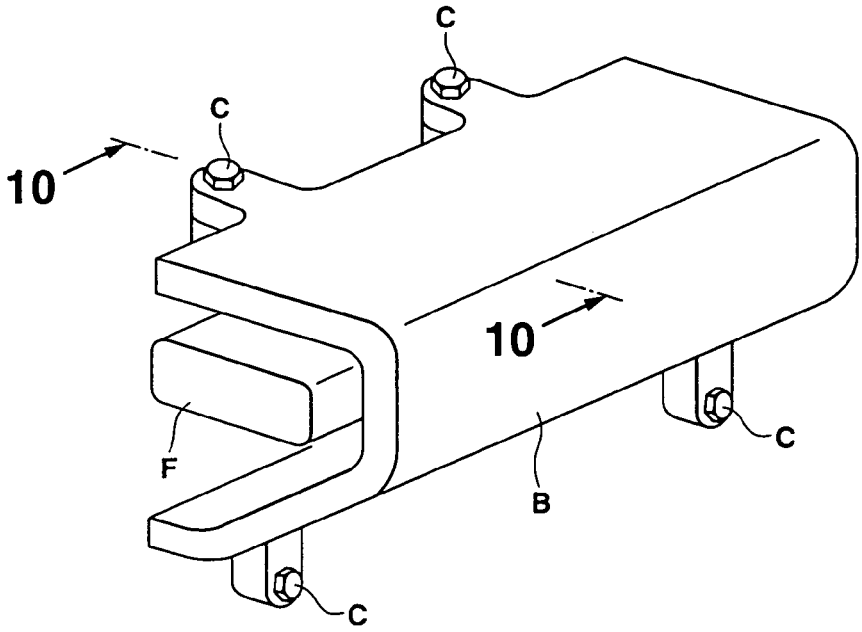
FIG. 9 is a perspective view of an apparatus for protecting a fuel system component for an engine, according to a comparative example of the present invention.
Figure 10:
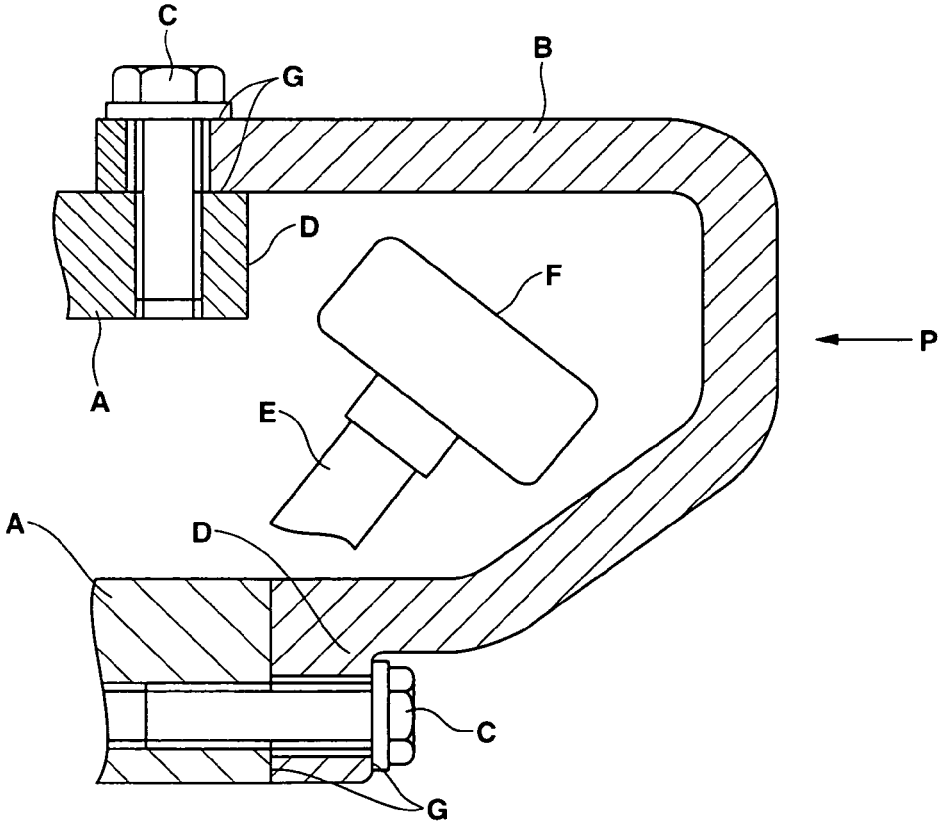
FIG. 10 is a sectional view taken along line 10—10 of FIG. 9.

FIGS. 9 and 10 show a fuel system component protecting apparatus of a comparative example. As seen from FIGS. 9 and 10, protector B is secured to engine body A by using two bolts C on an upper side of protector B and two bolts C on a lower side thereof. Protector B is made of cast material and thickened so as to provide a rigidly for protecting fuel injection valve E and fuel tube F without substantially being deformed. When impact load P is applied to protector B via a component, for instance, via a radiator, which is installed forward of the engine on the occurrence of vehicle collision, impact load P acts as a shear force and almost whole of impact load P is exerted onto abutting planes G between bolts C and protector B and between protector B and bosses D. The area of respective abutting planes G, therefore, must be increased. This causes increase in size of bolts C and bosses D, resulting in increase in weight and cost of the apparatus and deterioration in freedom of layout of components.

In contrast, the apparatus of the first embodiment of the present invention operates as follows. As illustrated in FIG. 3, when impact load P is applied to intake manifold 16 and protector 20 upon the occurrence of vehicle front collision, protector 20 is urged toward the engine body via subsidiary fastening member 46 and first and second subsidiary bosses 52 and 54. The distal end of second wall 24 is brought into abutment on the bottom of receptacle portion 38 of cylinder head 10. Simultaneously with the abutment of second wall 24, abutting portion 40 of first wall 22 is urged toward the engine body to move to the abutment position where the distal end thereof abuts on the circumferential side wall of first main boss 30. At this time, protector 20 is still held at the protection position where protector 20 covers and protects fuel system component 18 without interfering therewith. A space between protector 20 and fuel system component 18 is designed such that protector 20 can be held at the protection position even when the vehicle front collision occurs.

The apparatus of the first embodiment of the present invention can achieve the following effects. First, protector 20 is supported in a so-called cantilever form in which first wall 22 is secured to the engine body and second wall 24 is floatingly opposed to the bottom of receptacle portion 38 with clearance 34. This can reduce the number of fastening bolts for fixing protector 20 to thereby provide a simple fixing structure and facilitate an assembling operation of protector 20 to the engine body. Further, when impact load P is applied to protector 20 as shown in FIG. 3, abutting portion 40 of first wall 22 is urged to moved to the abutment position in contact with the circumferential side wall of first main boss 30. This can effectively absorb the impact energy. Further, protector 20 can be formed by subjecting a relatively light and thin metal plate to presswork and can realize the protection function, serving for reducing the weight and saving the cost. Further, upon the impact load being applied to protector 20, the distal end of second wall 24 abuts on the bottom of receptacle portion 38 of cylinder head 10, and is supported thereat. This enhances the support strength and rigidity of the apparatus, whereby the diameters of the fastening member and the boss receiving the fastening member and the weight of the apparatus can be reduced as compared with the apparatus of the comparative example in which the impact load is received by the abutting planes between the boss, the fastening member, and the fixed portion of the protector. Furthermore, since protector 20 has the so-called cantilever form and is secured to the engine body only at fixed portion 28 of first wall 22, the assembling operation of protector 20 by using main fastening member 26 and first main boss 30 can be facilitated.

Further, protector 20 is designed such that when impact load P is applied to protector 20 as shown in FIG. 3, abutting portion 40 of first wall 22 is brought into abutment on the circumferential side wall of first main boss 30. At this state, main fastening member 26 extending in first main boss 30 acts as a core of first main boss 30 and therefore provides significantly enhanced support strength and rigidity of first main boss 30. This results in effectively improving the support strength and rigidity of protector 20. Further, the apparatus of the first embodiment can be prevented from suffering from the problems of the above-described comparative example in which almost whole of the impact load is received by the abutting planes between the boss and the fixed portion of the protector and between the fastening bolt and the fixed portion thereof. The support strength and rigidity of first main boss 30 can be adequately maintained, and the diameters of main fastening member 26 and first main boss 30 can be reduced. This results in reduction of the whole weight of the apparatus of the first embodiment. Furthermore, when the impact load is applied to protector 20, abutting portion 40 of first wall 22 is urged to be displaced from the original position shown in FIG. 2 to the abutment position shown in FIG. 3. The impact energy can be effectively absorbed by the displacement of abutting portion 40.

Even when fixed portion 28 and abutting portion 40 of first wall 22 are separated from each other on the occurrence of break at step 42 due to the impact load applied to protector 20, abutting portion 40 is guided along a lower surface of fixed portion 28 and brought into abutment on the circumferential side surface of first main boss 30. On the other hand, the distal end of second wall 24 is brought into abutment on the bottom of recess 38. Fuel system component 18 is thus held in a fully protected state in which fuel system component 18 is sufficiently and effectively enclosed by almost whole part of protector 20 except fixed portion 28.

Further, protector 20 is fixedly supported on intake manifold 16 at three portions using one subsidiary fastening member 46 and two main fastening members 26. With this supporting structure, vibrations of protector 20 can be suppressed during traveling of the vehicle.

Furthermore, fixed portion 28, abutting portion 40 and step 42 therebetween of first wall 22 are integrally formed by bending. This serves for facilitating the production of protector 20 and saving the cost thereof.

Figure 5:
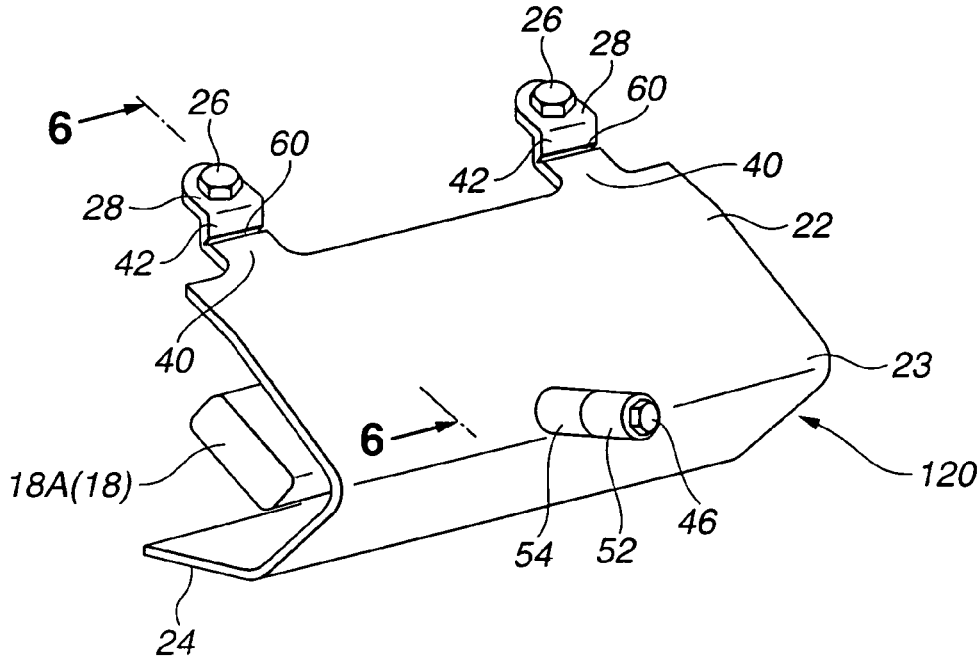
FIG. 5 is a view similar to FIG. 1, but showing the apparatus according to a second embodiment of the present invention.
Figure 6:
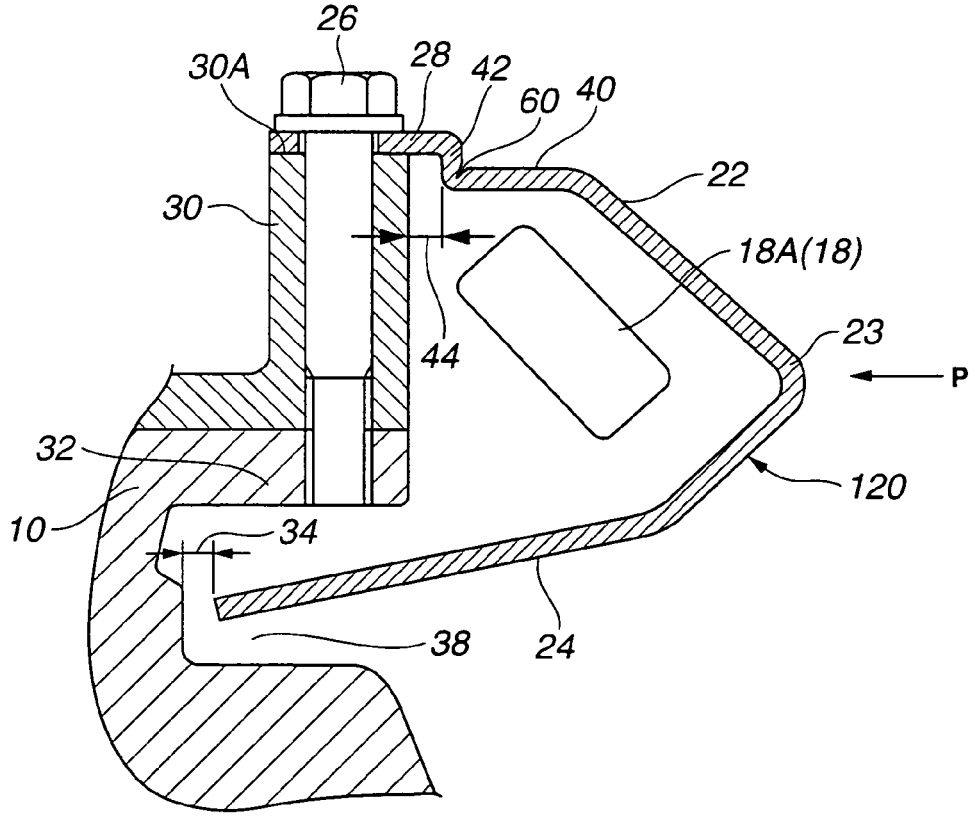
FIG. 6 is a sectional view taken along line 6—6 of FIG. 5.

Referring to FIGS. 5 and 6, a second embodiment of the apparatus of the present invention will be explained, which differs in provision of a fragile portion on the protector from the first embodiment. Like reference numerals denote like parts and therefore detailed explanations therefor are omitted. As illustrated in FIGS. 5 and 6, protector 120 has fragile portion 60 formed on an end portion of abutting portion 40 which is located on the side of the engine body. Fragile portion 60 is a thinned portion having a small thickness that is reduced by forming slit or groove on an upper surface of the engine body-sided end portion of abutting portion 40. Fragile portion 60 extends along a bend extending between abutting portion 40 and step 42.

The second embodiment can produce the same effects as those of the first embodiment as described above. Further, when impact load P is applied to protector 120 as shown in FIG. 6 on the occurrence of vehicle front collision, break will be caused at fragile portion 60. When abutting portion 40 is separated from step 42 due to the break at fragile portion 60, the distal end of abutting portion 40 is brought into abutment on the circumferential side surface of first main boss 30 and supported thereat. Thus, the impact energy can be prevented from concentrating onto an abutting plane between first main boss 30 and fixed portion 28 of first wall 22.

Figure 7:
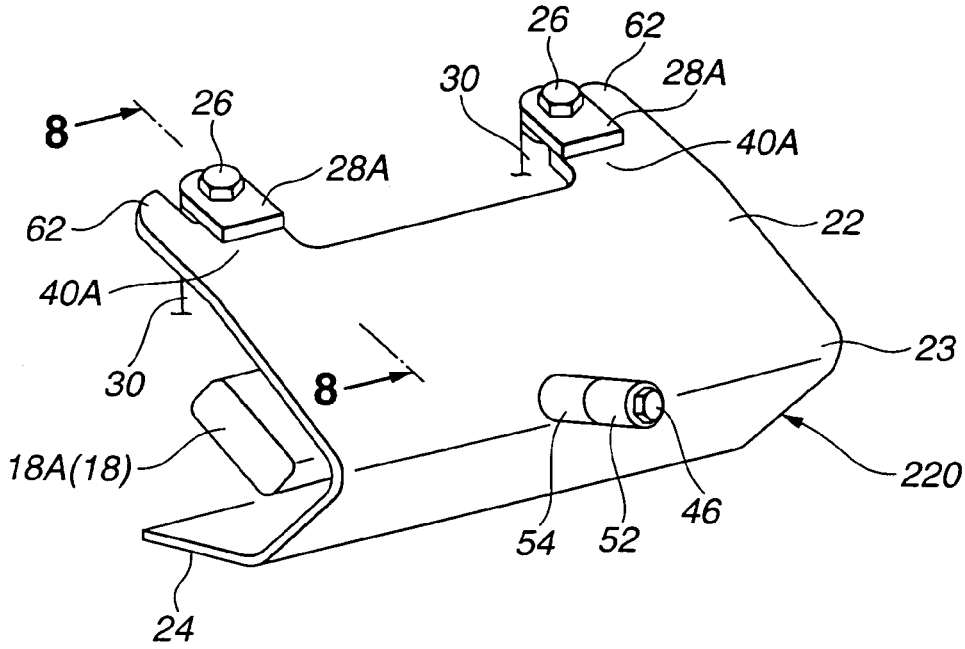
FIG. 7 is a view similar to FIG. 1, but showing the apparatus according to a third embodiment of the present invention.
Figure 8:
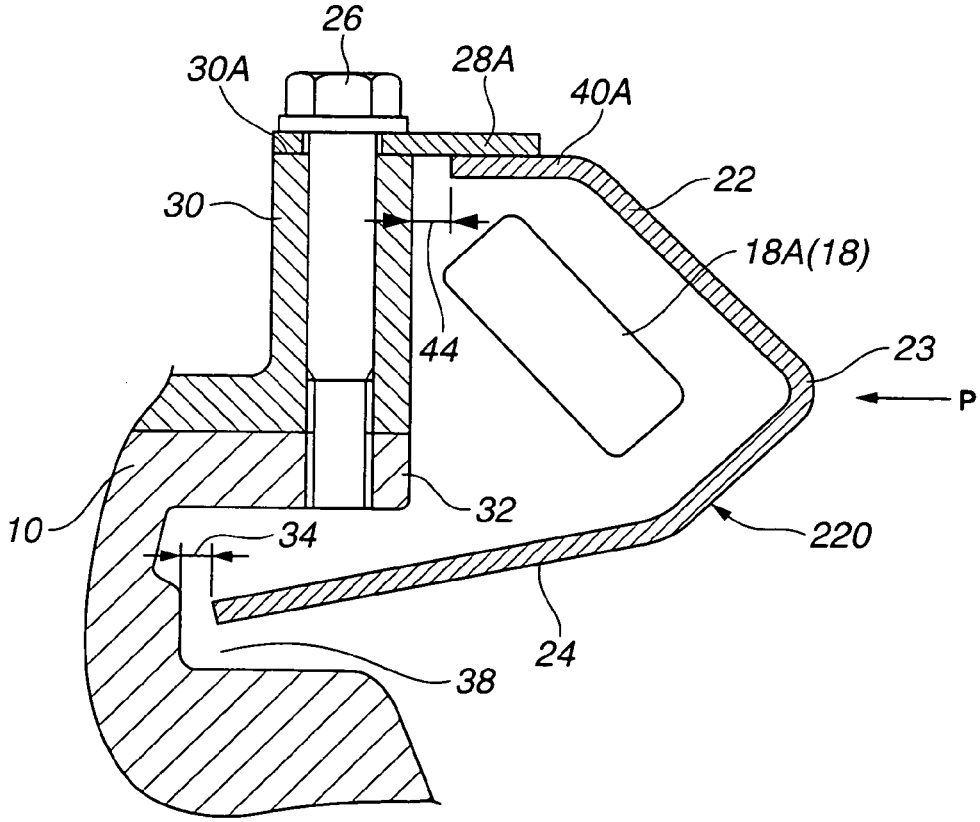
FIG. 8 is a sectional view taken along line 8—8 of FIG. 7.

Referring to FIGS. 7 and 8, a third embodiment of the apparatus of the present invention will be explained. The third embodiment differs in that fixed portion 28A and abutting portion 40A of the protector are provided as separate parts, from the first embodiment. As illustrated in FIGS. 7 and 8, first wall 22 of protector 220 includes fixed portion 28A and abutting portion 40A as separate parts. Fixed portion 28A and abutting portion 40A partially overlap with each other and joined together by spot-welding. Specifically, fixed portion 28A is disposed on an upper surface of abutting portion 40A so that abutting portion 40A is placed in a position offset downwardly, namely, in the axial direction of main fastening member 26, relative to fixed portion 28A. An end of abutting portion 40A which is located on the side of the engine body is opposed to the circumferential side surface of first main boss 30 with clearance 44. The welding joint strength is designed such that when impact load P is applied to protector 220 on the occurrence of vehicle front collision, break is caused at the welding joint portion between fixed portion 28A and abutting portion 40A so that abutting portion 40A is separated from fixed portion 28A. The third embodiment produces the same effects as those of the second embodiment.

The thickness of fixed portion 28A may be designed to be larger than that of abutting portion 40A. In this case, the rigidity of fixed portion 28A becomes larger than that of abutting portion 40A. When abutting portion 40A is separated from fixed portion 28A due to impact load P applied to protector 220 as shown in FIG. 8, fixed portion 28A can surely guide abutting portion 40A on the lower surface thereof to thereby ensure abutment against the circumferential side surface of first main boss 30. In addition, the rigidity of fixed portion 28A can be enhanced by forming a rib, not shown, on fixed portion 28A.

Further, protector 220 includes a pair of projections 62 that are disposed on opposed sides of first wall 22 and extend toward the engine body beyond the engine body-sided ends of abutting portions 40A. The pair of projections 62 are formed adjacent to abutting portions 40A and integrally therewith. The pair of projections 62 are arranged nearby main bosses 30 such that main bosses 30 are disposed between projections 62. When abutting portion 40A is separated from fixed portion 28A due to impact load P applied to protector 220, projections 62 and main bosses 30 cooperate with each other to prevent protector 220 from being displaced in the longitudinal direction of first wall 22, namely, in a direction perpendicular to a plane of FIG. 8. Thus, protector 220 can be held at the protection position where protector 220 surrounds fuel system component 18. Meanwhile, projections 62 can also be applied to the first and second embodiments.

Further, subsidiary fastening member 46 for fixing protectors 20, 120 and 120 to intake manifold 16 may be omitted.

This application is based on a prior Japanese Patent Application No. 2003-36858 filed on Feb. 14, 2003. The entire contents of the Japanese Patent Application No. 2003-36858 is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An apparatus for protecting a fuel system component disposed on an engine body in a vehicle, the apparatus comprising:

a protector including a first wall and a second wall connected with the first wall, the first and second walls extending toward the engine body and cooperating with each other to surround the fuel system component, the second wall having one end opposed to the engine body with a clearance; and a first fastening member fixing the first wall to the engine body, wherein the protector is spaced apart from the fuel system component.

2. The apparatus as claimed in claim 1, further comprising a first boss receiving the first fastening member and having a seat, the first boss being provided on the engine body, the first wall including a fixed portion fixed to the seat of the first boss in an overlapping state through the first fastening member and an abutting portion offset from the fixed portion in an axial direction of the first fastening member and opposed to a circumferential side surface of the first boss with a clearance.

3. The apparatus as claimed in claim 1, further comprising a first boss receiving the first fastening member and having a seat, the first boss being provided on the engine body, the first wall including a fixed portion fixed to the seat of the first boss in an overlapping state through the first fastening member and an abutting portion that is arranged so as to be displaced to an abutment position where the abutting portion abuts on a circumferential side surface of the first boss when a load is applied to the protector.

4. The apparatus as claimed in claim 2, wherein the fixed portion and the abutting portion are integrally formed by bending.

5. The apparatus as claimed in claim 4, wherein a fragile portion is formed at a bend between the fixed portion and the abutting portion, the fragile portion having a reduced thickness.

6. The apparatus as claimed in claim 2, wherein the fixed portion and the abutting portion are connected with each other in an overlapping state.

7. The apparatus as claimed in claim 1, further comprising a receptacle portion receiving the one end of the second wall, the receptacle portion being provided on the engine body.

8. The apparatus as claimed in claim 7, wherein the receptacle portion is a recess formed in the engine body.

9. The apparatus as claimed in claim 1, wherein the engine body is connected with an intake manifold arranged forward of the engine body in a fore-and-aft direction of the vehicle, the protector being arranged within a space defined between the intake manifold and the engine body.

10. The apparatus as claimed in claim 9, further comprising a second fastening member fixing the protector to the intake manifold.

11. An apparatus for protecting a fuel system component disposed on an engine body in a vehicle, the apparatus comprising:

a protector including a first wall and a second wall connected with the first wall, the first and second walls extending toward the engine body and cooperating with each other to surround the fuel system component, the second wall having one end opposed to the engine body with a clearance;

a first fastening member fixing the first wall to the engine body; and a receptacle portion receiving the one end of the second wall, the receptacle portion being provided on the engine body.

* * * * *